US009920481B2

(12) United States Patent
Chen et al.

(10) Patent No.: US 9,920,481 B2
(45) Date of Patent: Mar. 20, 2018

(54) LIGHTWEIGHT DIGITAL PRINTING MEDIUM

(71) Applicant: Hewlett-Packard Development Company, L.P., Fort Collins, CO (US)

(72) Inventors: Tao Chen, San Diego, CA (US); Xulong Fu, San Diego, CA (US); Thomas Roger Oswald, Boise, ID (US); Silke Courtenay, San Diego, CA (US); Christopher Arend Toles, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/119,620

(22) PCT Filed: Apr. 28, 2014

(86) PCT No.: PCT/US2014/035748

§ 371 (c)(1),
(2) Date: Aug. 17, 2016

(87) PCT Pub. No.: WO2015/167440

PCT Pub. Date: Nov. 5, 2015

(65) Prior Publication Data

US 2017/0058455 A1 Mar. 2, 2017

(51) Int. Cl.
*D21H 11/10* (2006.01)
*D21H 11/02* (2006.01)
(Continued)

(52) U.S. Cl.
CPC ..... *D21H 11/02* (2013.01); *D21H 11/08* (2013.01); *D21H 11/10* (2013.01); *D21H 17/52* (2013.01);
(Continued)

(58) Field of Classification Search
USPC ..... 162/141
See application file for complete search history.

(56) References Cited

U.S. PATENT DOCUMENTS 4,298,639 A 11/1981 Van Eenam
5,427,652 A 6/1995 Darlington et al.
(Continued)

FOREIGN PATENT DOCUMENTS

CN 101691701 4/2010
GB 2418380 3/2006
(Continued)

OTHER PUBLICATIONS

Extended European Search Report dated Apr. 4, 2017 for PCT/US2014/035748, Applicant Hewlett-Packard Development Company, L.P.
(Continued)

*Primary Examiner* — Mark Halpern
(74) *Attorney, Agent, or Firm* — Thorpe, North & Western L.L.P.

(57) ABSTRACT

A lightweight digital printing medium has a basis weight of less than 100 grams per square meter and includes a base paper. The base paper includes a fiber mixture of hardwood pulp and softwood pulp where at least 5% by weight of total fiber in the fiber mixture is bleached, chemi-thermo-mechanical pulp. An internal sizing agent for neutral or alkaline conditions and a wet-strength agent that is a thermosetting resin are mixed with the fiber mixture. An amount of the wet-strength agent added to the fiber mixture is at least 0.1% total dry weight of the base paper.

15 Claims, 1 Drawing Sheet

(51) Int. Cl.

| | |
|---|---|
| ***D21H 17/52*** | (2006.01) |
| ***D21H 17/55*** | (2006.01) |
| ***D21H 17/56*** | (2006.01) |
| ***D21H 21/16*** | (2006.01) |
| ***D21H 21/20*** | (2006.01) |
| ***D21H 11/08*** | (2006.01) |

(52) U.S. Cl.

CPC ..... *D21H 17/55* (2013.01); *D21H 17/56* (2013.01); *D21H 21/16* (2013.01); *D21H 21/20* (2013.01)

(56) References Cited

U.S. PATENT DOCUMENTS

| | | | |
|---|---|---|---|
| 5,609,964 | A | 3/1997 | Ogawa et al. |
| 6,440,269 | B1 | 8/2002 | Freeburn |
| 6,623,590 | B2 | 9/2003 | Ozaki et al. |
| 7,074,495 | B2 | 7/2006 | Tamagawa et al. |
| 7,789,996 | B2 | 9/2010 | Buzza et al. |
| 8,034,423 | B2 | 10/2011 | Kawakami et al. |
| 8,507,078 | B2 | 8/2013 | Gocho et al. |
| 2004/0256065 | A1 | 12/2004 | Ahmed et al. |
| 2006/0144541 | A1 | 7/2006 | Joy Nickel et al. |
| 2009/0317549 | A1 | 12/2009 | Tan et al. |
| 2011/0205287 | A1 | 8/2011 | Zhou et al. |
| 2013/0288040 | A1 | 10/2013 | Kozlowski et al. |

FOREIGN PATENT DOCUMENTS

| | | |
|---|---|---|
| JP | 10046498 | 2/1998 |
| KR | 20090120073 | 11/2009 |
| WO | 0149938 | 7/2001 |
| WO | 2009110910 | 9/2009 |

OTHER PUBLICATIONS

International Search Report dated Jan. 14, 2015 for PCT/US2014/035748, Applicant Hewlett-Packard Development Company, L.P.

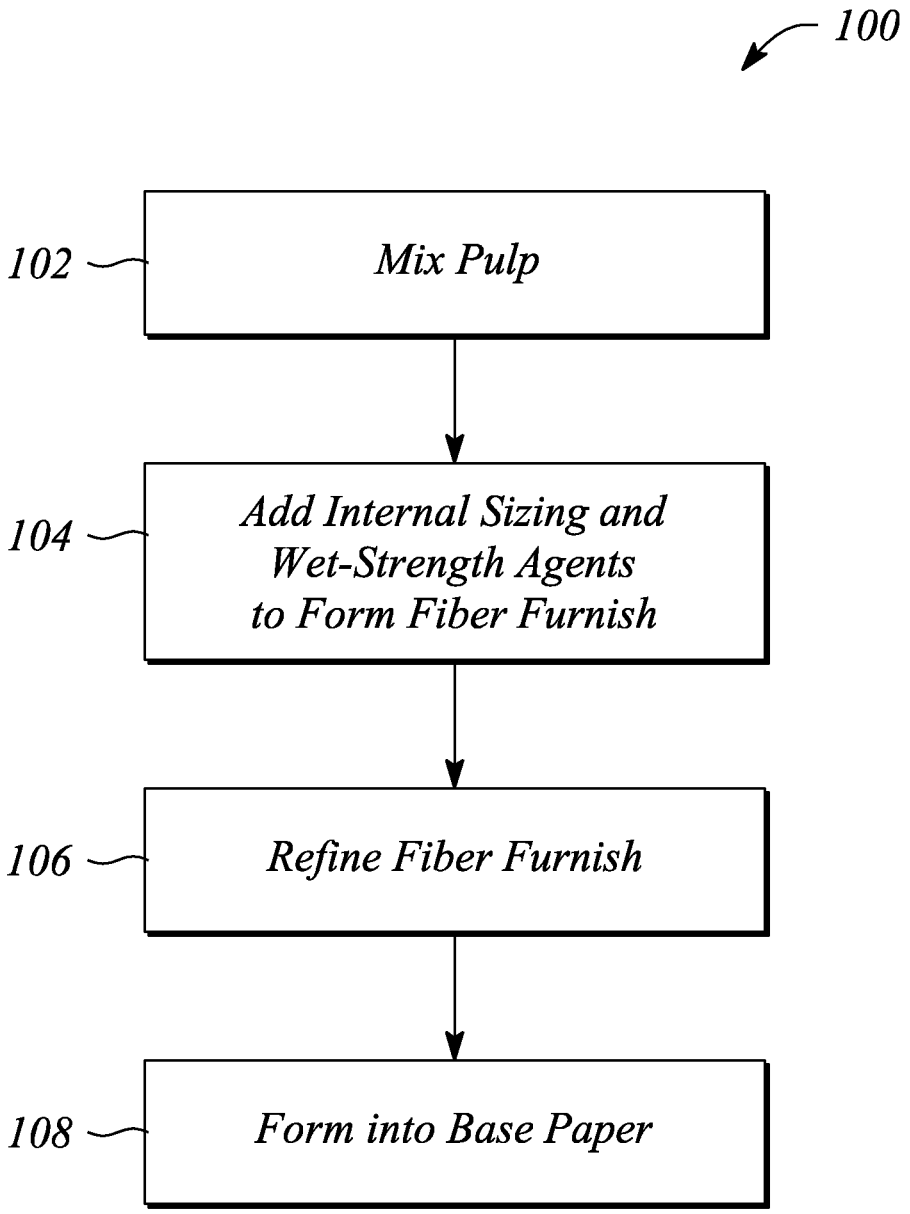
100
102
Mix Pulp
104
Add Internal Sizing and Wet-Strength Agents to Form Fiber Furnish
106
Refine Fiber Furnish
108
Form into Base Paper

LIGHTWEIGHT DIGITAL PRINTING MEDIUM

CROSS-REFERENCE TO RELATED APPLICATIONS

This application is a 371 of PCT/US2014/035748 filed 28 Apr. 2014.

STATEMENT REGARDING FEDERALLY SPONSORED RESEARCH OR DEVELOPMENT

N/A

BACKGROUND

There are a variety of methods for commercial high-speed printing to produce large quantities of print material, such as books, magazines, newsprints, and brochures. In the past, traditional analog printers, such as web fed offset and gravure contact printers, were the most common type of printers for such commercial applications. In recent years, high-speed, digital, inkjet web-fed printers have become more prevalent due to 100% variable print content and multi-color printing at a relatively low cost to consumers.

Print media used in printing images, especially with high-speed printers, are subject to problems relating to one or more of cockle, curl, wrinkle, crease and mis-registration and other similar problems, which can detrimentally impact productivity, product quality and cost. For example, digital inkjet printing using aqueous inkjet inks can result in a large amount of water added to the cellulose-based print media at high speeds. Sufficient time is needed to dry the printed media to remove as much of the moisture as possible during inkjet printing. Without sufficient drying time, the printed media may suffer from waviness, cockle, curl, or other problems listed above. However, allowing for sufficient time to dry the printed media during inkjet printing tends to be counterproductive to using high-speed digital printers.

BRIEF DESCRIPTION OF THE DRAWINGS

Various features of examples in accordance with the principles described herein may be more readily understood with reference to the following detailed description taken in conjunction with the accompanying drawings, where like reference numerals designate like structural elements, and in which:

FIG. 1 illustrates a flow chart of a method of manufacturing lightweight digital printing media according to an example consistent with the principles described herein.

Certain examples have other features that are one of in addition to and in lieu of the features illustrated in the above-referenced figures. These and other features are detailed below with reference to the above-referenced figures.

DETAILED DESCRIPTION

Examples in accordance with the principles described herein are directed to a lightweight digital printing medium. In particular, the lightweight digital printing medium has a relatively improved or stable flatness, in that only a relatively small amount of change in flatness is observed after images are printed on the lightweight digital printing medium using aqueous inkjet inks More particularly, the digital printing medium is lightweight in that it has a basis weight or grammage that is less than 100 grams per square meter (gsm), which may render the digital printing medium as a bookgrade print medium, for example. Such a lightweight digital printing medium with a stable flatness facilitates production, product quality and cost of printed media, which are advantageous to paper manufacturers and users alike. The relatively improved flatness of the lightweight digital printing medium is especially advantageous to high-speed printing using a digital, high-speed, inkjet printer (e.g., web-fed or sheet-fed), of products like books, including textbooks, and manuals, for example.

The lightweight digital printing medium according to the principles described herein includes a cellulose fiber-based paper substrate (i.e., 'base paper'). The base paper includes a fiber mixture of hardwood and softwood pulps, and an internal sizing agent and a wet-strength agent mixed into the fiber mixture at the wet-end of paper manufacturing. At least about 5% by weight of total fiber in the fiber mixture is bleached, chemi-thermo-mechanical pulp (BCTMP). Moreover, the base paper has at least about 0.1% total dry weight of the base paper of the wet strength agent. The internal sizing agent and the wet-strength agent are in addition to other internal sizes, fillers and additives included in a fiber furnish to make various cellulose fiber-based print media, and especially a print medium for high-speed, digital inkjet printing.

The internal sizing and wet-strength agents in conjunction with the fiber mixture, along with the amounts thereof, according to the principles herein provide strength and dimensional stability to the lightweight digital printing medium that facilitates a relatively improved flatness. The strength and dimensional stability are sufficient to handle high moisture levels during digital printing, in particular high-speed inkjet printing with aqueous inkjet ink, and do so with one or more of reduced cockle, reduced curl and reduced waviness and wrinkling, to name a few, associated with the high moisture levels. For example, the internal sizing and wet-strength agents in conjunction with the fiber mixture facilitate maintaining a level of flatness of the lightweight digital printed medium, i.e., after the lightweight medium is subjected to digital inkjet printing, e.g., with aqueous inkjet ink. In some examples, the flatness is less than 0.35, as determined by a root mean squared (RMS) roughness measured before and after an image is printed on the lightweight digital printing medium.

A method of manufacturing lightweight digital printing media includes adding to a pulp mixture both an internal sizing agent and at least 0.1% of a wet-strength agent based on total dry weight of base paper at the wet-end of paper manufacturing using a paper making machine to form a fiber furnish. The pulp mixture includes hardwood and softwood fibers and has at least 5% BCTMP by weight of total fiber in the pulp mixture. The formed fiber furnish is refined, formed into a web or sheet of the base paper. The base paper is further processed at a dry end of the paper making machine, or offline, into the lightweight digital printing media. For example, forming the base paper includes drying and calendering. The lightweight digital printing media made by this method has a basis weight or grammage of less than 100 gsm, or for example, less than 90 gsm.

The lightweight digital printing medium may be uncoated or coated. In some examples, the lightweight digital printing medium according to the principles herein, whether uncoated or coated for a specific application, may be useful to analog printing technologies as well as digital printing technologies.

As used herein, the article 'a' is intended to have its ordinary meaning in the patent arts, namely 'one or more'. For example, 'an agent' generally means one or more agents and as such, 'the agent' means 'the agent(s)' herein. The phrase 'at least' as used herein means that the number may be equal to or greater than the number recited. The phrase 'no greater than' as used herein means that the number may be equal to or less than the number recited. The phrase 'less than' as used herein means the number is less than the recited number. The term 'about' as used herein means that the value recited is within the normal tolerances of the equipment used to measure the value; or in some examples, the value may differ by plus or minus 20%, or plus or minus 15%, or plus or minus 10%, or plus or minus 5%, or plus or minus 1%, for example. The term 'between' when used in conjunction with two numbers such as, for example, 'between about 2 and about 50' includes both of the numbers recited. Any ranges of values provided herein include values within or between the provided ranges. The term 'substantially' as used herein means a majority, or almost all, or all, or an amount with a range of about 51% to 100%, for example.

Also, any reference herein to 'top', 'bottom', 'upper', 'lower', 'up', 'down', 'back', 'front', 'left' or 'right' is not intended to be a limitation herein. The designations 'first' and 'second' if used herein is for the purpose of distinguishing between items, such as 'first side' and 'second side', and are not intended to imply any sequence, order or importance to one item over another item or any order of operation, unless otherwise indicated. Moreover, examples herein are intended to be illustrative only and are presented for discussion purposes and not by way of limitation. Moreover, the term 'basis weight' is used herein to mean 'grammage' with respect to the pulp and paper industry, and is expressed in grams per meter (gsm).

As used herein, the term 'book grade' or 'book-grade' means a print medium that has a property consistent with book printing, for example paper used in bound printed books, including textbooks and manuals. The book-grade paper properties may include opaqueness (i.e., for little to no show-through from opposites of the paper), precise thickness or caliper, weight or grammage and volume. Further, some book publishers also may refer to a 'pages per inch' (PPI) specification of the book-grade paper. For example, the North American textbook standards according to the "Manufacturing Standards and Specifications for Textbooks" developed by the National Association of State Textbook Administrators, the Association of American Publishers and the Book Manufacturers Institute may be used by many book publishers. The PPI specification is based on the caliper of the book-grade paper and also provides a description of the bulk of the paper.

The term 'digital printing', as used herein, means variable content, direct-to-surface printing of imaging materials as opposed to offset printing technologies, or those that include an analog component. For example, 'digital printing' includes inkjet printing using inkjet inks as the imaging material, and further includes within its scope high-speed, inkjet printing. When used as an adjective to describe a print medium, the term 'digital printing' invokes structural or compositional requirements on the print medium to render the print medium suitable for digital printing, especially using aqueous inkjet inks and high-speed inkjet printing. For example, the structural or compositional requirements provide dimensional stability and strength to the print medium that reduce or in some examples, minimize, one or more of cockle, wrinkle, curl, warp, and waviness when the print medium is exposed to high moisture levels and quick drying cycles during inkjet printing, for example moisture levels and drying times associated with high-speed printing with aqueous inkjet ink. Moreover, 'inkjet ink' means an imaging material that comprises a pigment or dye that imparts color (e.g., a CMYK color gamut) in either an aqueous or non-aqueous carrier fluid. By 'high-speed' it is meant a printing speed of about 30.5 meters per minute or more (e.g., 100 feet/min. or more).

In some examples of the principles described herein, a lightweight digital printing medium is provided. The printing medium includes a cellulose or wood-based fiber base paper. The base paper includes a fiber mixture that includes pulps of hardwood fibers and softwood fibers. At least 5% by dry weight of total fiber in the fiber mixture is a bleached, chemi-thermo-mechanical pulp (BCTMP). The base paper further includes an internal sizing agent and a wet strength agent mixed with the fiber mixture. An amount of the wet strength agent in the fiber mixture is at least 0.1% total dry weight of the base paper. The lightweight digital printing medium according to the principles described herein has a basis weight of less than 100 gsm.

In some examples, the fiber mixture may further include one or more fillers and additives. The fillers and additives include, but are not limited to, inorganic fillers, pigments, optical brighteners, fixers, pH adjustors, emulsification products, strengtheners, and coloring agents. The fillers and additives are provided to the fiber mixture to render the base paper one or more of smooth, durable, strong, porous or nonporous, bright, and water resistant, for example.

Examples of suitable hardwood and softwood fiber pulps include, but are not limited to, chemical softwood pulp and chemical hardwood pulp. Chemical softwood pulp includes, but is not limited to, softwood kraft pulps and softwood sulfite pulps, that may be bleached or unbleached. Chemical hardwood pulp includes, but is not limited to, bleached or unbleached hardwood kraft pulps and hardwood sulfite pulps. Bleached pulp is used to avoid possible brownish tint typically found in unbleached pulp. The bleached chemi-thermo-mechanical pulp (BCTMP) in the fiber mixture is one of softwood pulp, hardwood pulp, or a mixture of softwood and hardwood pulps. Examples of softwood species that may be used in the softwood pulp include, but are not limited to, one or more of pine, spruce, fir, larch, hemlock, and a mixture of two or more species thereof. Examples of hardwood species that may be used in the hardwood pulp include, but are not limited to, one or more of eucalyptus, birch, aspen, and a mixture of two or more species thereof. Hardwood fibers have a shorter fiber structure and may have reduced strength with refining than softwood fibers.

In some examples herein, the amount of BCTMP in the fiber mixture is within a range of at least 5% to about 60% by dry weight of total fiber in the fiber mixture. In some examples, the amount of BCTMP by dry weight of total fiber in the fiber mixture is within a range of about 7% to about 60%, or about 8% to about 60%, or about 9% to about 60%, or about 10% to about 60%, or about 12% to about 60%, or about 15% to about 60%, or about 20% to about 60%, or about 30% to about 60%. In some examples, the amount of BCTMP by dry weight of total fiber in the fiber mixture is within a range of 5% to about 55%, or 5% to about 50%, or 5% to about 45%, or 5% to about 40%, or 5% to about 35%, or 5% to about 30%. In some examples, the BCTMP is a mixture of hardwood and softwood pulps in an amount within a range of 5% to about 60% by dry weight of total fiber in the fiber mixture. In some examples, the BCTMP is a mixture of hardwood and softwood pulps in amount within a range of about 10% to about 50% by dry weight of total fiber in the fiber mixture.

In some examples, the BCTMP is softwood pulp, and an amount of total softwood pulp in the fiber mixture is the combination of the amounts of softwood BCTMP and softwood chemical pulp. In some examples, the BCTMP is hardwood pulp, and an amount of total hardwood pulp in the fiber mixture is the combination of the amounts of hardwood BCTMP and hardwood chemical pulp. In some examples, the BCTMP includes both hardwood pulp and softwood pulp and the total of each pulp type in the fiber mixture is the sum of the respective chemical pulp amount and the respective portion of the BCTMP amount. In some examples, a ratio of amounts of the total hardwood pulp to total softwood pulp in the fiber mixture is within a range of about 1:2 to about 2:1 (i.e., about 1 part hardwood to (:) about 2 parts softwood to about 2 parts hardwood to (:) about 1 part softwood). In some examples, the ratio of amounts of the total hardwood pulp to total softwood pulp in the fiber mixture is within a range of about 1:2 to about 1:7 (i.e., about 1 part hardwood: about 2 parts softwood to about 1 part hardwood: about 7 parts softwood, or 'total hardwood pulp : total softwood pulp' for each ratio). In some examples, the ratio of amounts of the total hardwood pulp to total softwood pulp in the fiber mixture within a range of about 1:2 to about 7:1, or about 1:2 to about 5:1, or about 1:2 to about 3:1 (i.e., each, 'total hardwood pulp : total softwood pulp'). In some examples, the ratio of amounts of the total hardwood pulp to total softwood pulp in the fiber mixture within a range of about 1:2 to about 1:6, or about 1:2 to about 1:4, or about 1:2 to about 1:3 (i.e., each, 'total hardwood pulp:total softwood pulp').

In some examples, the fiber mixture comprises an amount of the hardwood chemical pulp within a range of about 10% to about 80%, an amount of the softwood chemical pulp within a range of about 10% to about 80%, and an amount of the BCTMP within a range of 5% to about 60% (whether softwood-based, hardwood-based or a combination or mixture thereof), each by weight of total fiber in the fiber mixture. In some examples, the fiber mixture comprises about 30% of the hardwood chemical pulp, about 40% of the softwood chemical pulp, and about 30% of the BCTMP (whether softwood-based, hardwood-based or a combination thereof), each by weight of total fiber in the fiber mixture.

The base paper of the lightweight digital printing medium further includes an internal sizing agent for neutral or alkaline conditions and a wet-strength agent that is a thermosetting resin. The internal sizing agent and the wet-strength agent are in addition to other additives that may be included in a fiber furnish at the wet end of paper manufacturing. In some examples, the internal sizing agent is selected from the group of neutral or alkaline internal sizing agents consisting of alkenyl succinic anhydride (ASA), alkyl ketene dimer (AKD), and combinations thereof An example of a suitable ASA internal sizing agent includes, but is not limited to, Nalsize™7540, which may be obtained from Nalco Company, Naperville, Ill., USA. An example of a suitable AKD includes, but is not limited to, Hercon® 80 from Hercules, Inc., Wilmington, Del., USA. Other suitable ASA and AKD agents include Basoplast® ASA and AKD internal sizes from BASF, Florham Park, N.J., USA, for example. In some examples, the internal sizing agent is mixed into the fiber mixture in an amount within a range of about 0.5 to about 3 kilograms per ton (kg/ton) of dry base paper (or equivalently, about 0.05% to about 0.3% of total dry weight of the base paper). In some examples, the amount of internal sizing agent for neutral or alkaline conditions mixed into the fiber mixture ranges from about 0.5 to about 2.5 kg/ton, or about 0.5 to about 2.0 kg/ton, or about 0.5 to about 1.5 kg/ton, or 0.5 to about 1.0 kg/ton. In other examples, the amount of internal sizing agent for neutral or alkaline conditions mixed into the fiber mixture ranges from about 0.7 to about 3 kg/ton, or about 0.9 to about 3 kg/ton, or about 1.2 to about 3 kg/ton, or about 1.4 to about 3 kg/ton. In some examples, the neutral or alkaline internal sizing agent is provided in the fiber mixture in an amount of about 1.6 kg/ton.

The wet-strength agent mixed into the fiber mixture is selected from the group of thermosetting resins consisting of polyamine-epichlorohydrin, polyamide-epichlorohydrin, polyamide-amine-epichlorohydrin, polyamide, epoxide, glyoxal, and a combination of two or more thereof Examples of suitable wet-strength agents include, but are not limited to, the Kymene™ wet strength additives from Ashland Inc., Covington, Ky., USA, for example, Kymene™821, a polyamide-epichlorohydrin. The thermosetting resin wet-strength agent is mixed into the fiber mixture in an amount within a range of at least 0.1% to about 3% of total dry weight of the base paper, for example. In some examples, the amount of thermosetting resin wet-strength agent in percent total dry weight of the base paper mixed into the fiber mixture ranges from 0.1% to about 2.5%, or 0.1% to about 2.0%, or 0.1% to about 1.5%, or 0.1% to about 1.2%. In other examples, the amount in percent total dry weight of the base paper of thermosetting resin wet-strength agent mixed into the fiber mixture ranges from about 0.25% to about 3%, or about 0.5% to about 3%, or about 0.75% to about 3%, or about 1.0% to about 3%, or about 1.25% to about 3%. In some examples, thermosetting resin wet-strength agent is mixed in the fiber mixture in an amount of about 1% of total dry weight of the base paper.

As mentioned above, the fiber mixture may further include other additives at the wet-end of paper manufacturing, in addition to the internal sizing agent and wet-strength agent described above. For example, other internal sizes that may be included in the fiber mixture are selected from the group consisting of metal salts of fatty acids, fatty acids, alkyl ketene dimer (AKD) emulsification products, epoxidized higher fatty acid amides, alkenyl acid anhydride emulsification products, alkenyl succinic anhydride (ASA) emulsification products, and rosin derivatives. Examples of inorganic fillers and pigments that may be included in the fiber mixture at the wet-end of paper manufacturing include, but are not limited to, ground calcium carbonate, precipitated calcium carbonate, titanium dioxide, kaolin clay, silicates, plastic pigment, alumina trihydrate and combinations of any of the above. Other additives that may be included in the fiber mixture at the wet-end of paper manufacturing, include, but are not limited to, optical brightening agents (OBA), for example, disulfonated stilbenes; and fixers or binders, for example, polyvinyl alcohol, ethers, latexes, and styrene acrylate copolymers.

The lightweight digital printing medium according to the principles described herein has a basis weight (or 'grammage') that is less than 100 gsm. In some examples, the basis weight of the lightweight digital printing medium is less than 90 gsm, or less than 80 gsm, or less than 70 gsm. In some examples, the basis weight of the lightweight digital printing medium is within a range of about 35 gsm to about 95 gsm, or about 35 gsm to about 90 gsm, or about 35 gsm to about 85 gsm, or about 35 gsm to about 80 gsm, or about 35 gsm to about 75 gsm, or about 35 gsm to about 70 gsm.

In some examples, the basis weight of the lightweight digital printing medium is within a range of about 37 gsm to less than 100 gsm, or about 39 gsm to less than 100 gsm, or about 41 gsm to less than 100 gsm, or about 43 gsm to less than 100 gsm, or about 40 gsm to less than 90 gsm, or about 40 gsm to less than 80 gsm, or about 40 gsm to about 70 gsm, or greater than 35 gsm to less than 75 gsm, or about 60 gsm to less than 100 gsm, or about 60 gsm to about 90 gsm. In some examples, the basis weight of the lightweight digital printing medium is within a range of 40 gsm to 67 gsm, or 40 gsm to less than 60 gsm. In some examples, the basis weight of the lightweight digital printing medium is about 40 gsm to 55 gsm, which is notably less than basis weight of other book-grade paper, i.e., less than a range of 60 gsm to 100 gsm, or greater.

In some examples, the basis weight of the lightweight digital printing medium is substantially the same as the basis weight of the base paper thereof (and vice versa). For example, the basis weight of the base paper may be within a range of about 35 gsm to less than 100 gsm. In some examples, the basis weight of the base paper is within a range of 35 gsm to about 75 gsm, or about 35 gsm to about 70 gsm, or about 35 gsm to about 65 gsm, or about 35 gsm to about 60 gsm, or about 35 gsm to less than 60 gsm, or about 35 gsm to less than 55 gsm. In some examples, the basis weight of the base paper is within a range of about 40 gsm to about 70 gsm, or 40 gsm to 67 gsm, or substantially any of the other ranges noted above for the lightweight digital printing medium.

The thickness or caliper of paper may be measured in units of mils (thousandths of an inch, 1 mil =25.4 micrometers (microns μ)) using a micrometer according to TAPPI Standard T441. The caliper and the basis weight of paper may be used to calculate paper volume and the PPI for book-grade paper, which may be useful to the publishing industry, as described above. In some examples, the lightweight digital printing medium according to the principles herein may have caliper that is less than 4.0 mils (<101.6 microns), or less than 3.0 mils (<76.2 microns), or less than 2.0 mils (<50.8 microns), or about 1 mil (or about 25 microns). In some examples, the caliper is within a range of about 0.5 mils (or about 13 microns) to about 3.9 mils (or about 100 microns). In some examples, the lightweight digital printing medium according to the principles herein may have a PPI that is greater than 470, or greater than 485, or greater than 500, or more. In some examples, the PPI is within a range of about 475 to about 700.

According to various examples, it is the combination of the fiber mixture of hardwood and softwood pulps that also includes at least 0.5% BCTMP, the internal sizing agent for neutral or alkaline conditions and at least 0.1% of the thermosetting resin wet-strength agent, as described herein, that provides a lightweight digital printing medium that may be lighter weight than other book-grade paper, as defined herein, and while also having dimensional stability and strength. Such lightweight-ness, stability and strength configure the printing medium for high-speed digital inkjet printing with aqueous inkjet inks Other lightweight media and book-grade paper do not have the stability or strength for high-speed digital inkjet printing with aqueous inkjet inks, based on various degrees of cockle, wrinkling, or waviness, etc. exhibited after such inkjet printing. One measure of strength and stability, or dimensional stability, in accordance with the principles herein, is whether and how much the flatness of a print medium changes before and after exposure to digital inkjet printing conditions using aqueous inkjet inks The lightweight digital printing medium according to the principles described herein has a stable flatness, which is an improvement over other lightweight papers, as described above. By 'stable' or 'improved' it is meant that a change in a flatness level of a print medium before and after printing an image with an aqueous inkjet ink is at least less than the change in flatness of other lightweight papers under substantially the same conditions. For example, the change in flatness of the lightweight digital printing medium can be determined by a root-mean-squared (RMS) roughness of the print medium before and after printing an image. For example, a profilometer, such as a laser profilometer, may be used to measure a distance from a detector of the profilometer to a surface of the print medium before and after printing. The laser is read across the surface in the cross direction (CD) (i.e., across the short direction of the sheet or web). The distance to the surface is measured in approximately the same location or locations before and after printing. Then, the values measured for the medium (before printing) are subtracted from the values measured for the printed medium (after printing) and reported as Rq (RMS roughness) according to equation 1:

$$Rq = \sqrt{\frac{\sum_1^N y^2}{N}}$$

where y equals a difference between distances from the detector to the surface of the medium (i.e., printed values subtracted from unprinted values at approximately the same locations); and N equals the number of measured values.

In some examples, the RMS roughness (or 'flatness' herein) of the lightweight digital printing medium according to the principles described herein is less than 0.35. In some examples, the RMS flatness of the lightweight digital printing medium is less than 0.33, or less than or equal to 0.31, or less than or equal to 0.30, or less than or equal to 0.29. As a comparison, paper media without the combination of ingredients described for the lightweight digital printing medium according to the principles herein has an RMS flatness that is either equal to or greater than 0.35, and for example, may range from 0.35 to 0.48 or more, depending on the print medium.

In some examples of the principles described herein, a method of making lightweight digital printing media is provided. FIG. 1 illustrates a flow chart of a method 100 of manufacturing lightweight digital printing media according to an example consistent with the principles described herein. The method 100 of manufacturing includes mixing 102 together a pulp mixture that comprises hardwood pulp and softwood pulp, where at least 5% by weight of total fiber in the pulp mixture is bleached, chemi-thermo-mechanical pulp (BCTMP). In some examples, the pulp mixture is substantially the same as the fiber mixture of the base paper in the lightweight digital printing medium described above. For example, the pulp mixture includes hardwood chemical pulp and softwood chemical pulp along with the BCTMP. Moreover, the BCTMP may be hardwood pulp, softwood pulp, or a combination or mixture of hardwood and softwood pulps. The total amount of hardwood chemical pulp and the total amount of softwood chemical pulp in the pulp mixture may be provided as a ratio or a range of ratios. For example, a ratio of amounts of the total hardwood pulp to total softwood pulp in the pulp mixture is within a range of about 1:2 to about 2:1. In some examples, the ratio of amounts of the total hardwood pulp to total softwood pulp in the pulp mixture is within a range of about 1:2 to about 1:7.

The method 100 of manufacturing further includes adding 104 both an internal sizing agent for neutral or alkaline conditions and a wet-strength agent that is a thermosetting resin to the pulp mixture to form a fiber furnish. In some examples, the internal sizing agent and the wet-strength agent are substantially the same as the respective agents described above in the base paper of the lightweight digital printing medium. In some examples, the internal sizing agent is selected from ASA, AKD and a combination thereof The internal sizing agent is added 104 to the pulp mixture in an amount that ranges from about 0.5 kg/ton to about 3 kg/ton. The wet-strength agent is added 104 to the pulp mixture in an amount of at least 0.1% total dry weight of base paper. The added 104 agents are mixed into the pulp mixture to form a fiber furnish, e.g., an aqueous pulp slurry.

The method 100 of manufacturing further includes refining 106 the fiber furnish to a Canadian Standard Freeness (CSF) level that is within a range of about 350 to about 500 milliliters (ml). For example, the fiber furnish is refined 106 using mechanical refining, for example using a continuous refiner including, but not limited to, a disk refiner (e.g., single or double disk refiners), a conical refiner (e.g., low angle types like a Jordan refiner or high angle types like a Claflin refiner), or a beater (e.g., Hollander beater or a Valley beater). The fiber furnish is refined 106 until the CSF level is within the above-stated range. The CSF level may be monitored or determined using TAPPI Standard T227.

In some examples, the fiber furnish is refined 106 until the CSF level is within a range of about 350 ml to about 480 ml, or about 350 ml to about 460 ml, or about 350 ml to about 440 ml. In some examples, the fiber furnish is refined 106 until the CSF level is within a range of about 370 ml to about 500 ml, or about 390 ml to about 500 ml, or about 410 ml to about 500 ml, or about 425 ml. to about 500 ml. In some examples, the CSF level of the refined 106 fiber furnish is about 400 ml to about 450 ml. In some examples (not illustrated), the pulp mixture is refined before one or both of the internal sizing agent and the wet-strength agent are added to the pulp mixture to form the furnish. In other examples, the method of making further includes refining the pulp mixture before one or both agents are added, as well as refining 106 the fiber furnish after the agents are added 104.

In accordance with the method 100 of making lightweight digital printing media, the pulp is mixed 102, the internal sizing agent and the wet-strength agent are added 104 to form the fiber furnish, and the fiber furnish is refined 106, all at the wet-end of paper making, for example, using a paper making machine (e.g., a Fourdrinier paper machine). The method 100 of manufacturing further includes forming 108 the refined fiber furnish into a web or sheet of base paper, e.g., with the paper making machine. During forming 108 the web or sheet, most of the liquid is removed from the base paper and the lightweight digital printing media is made. In some examples, the lightweight digital printing media, and base paper thereof, are substantially the same as the lightweight digital printing medium and the base paper thereof, described above.

In some examples, forming 108 the fiber furnish into the web or sheet of base paper comprises drying the base paper web or sheet, and in some examples, further comprises calendering the base paper web or sheet, both at a dry-end of paper making, for example in the paper making machine. Drying the base paper web or sheet may use equipment that provide convection, conduction, infra-red radiation, atmospheric exposure, or a combination of one or more of these, for example, in a drying section of the paper making machine. Calendering uses calendering rollers under pressure control, for example, in a calendering section of the paper making machine. Calendering may provide a targeted finish to the base paper web or sheet, e.g., a gloss level, depending on the pressure of the calendering rollers. In some examples, the dried and calendered web or sheet of base paper that is formed 108 is the lightweight digital printing media, made by the method 100, according to the principles described herein.

Moreover, as a result of calendering, a substantially uniform thickness of the lightweight digital printing media or the base paper thereof may be achieved. In some examples, basis weight in grams per square meter (gsm) is approximately equivalent to thickness (or caliper) in microns, for example 1 gsm approximately equals 1 micron. As such, the lightweight digital printing media comprising the base paper formed 108 in accordance with the method 100 of manufacturing, has a substantially uniform thickness or caliper that is within a range of about 25 microns to less than 100 microns. In some examples, the thickness or caliper of the base paper, or of the lightweight digital printing media, is within a range of about 35 microns to about 75 microns. Other ranges of the thickness or caliper in microns for the lightweight digital printing media made by the method 100, or the base paper thereof, are substantially the same as described above for the lightweight digital printing medium (or e.g., the base paper thereof).

In some examples, the method 100 of manufacturing lightweight digital printing media may further comprise coating the web or sheet of base paper that is formed 108, for example with treatments, including, but not limited to, surface sizing compositions, image receiving compositions, and other compositions that may configure the lightweight digital printing media with a particular characteristic, or for a particular purpose or use. The image receiving composition may be configured to facilitate receipt of an image of aqueous inkjet ink printed on the surface of the medium, for example. The surface treatments may be applied and calendared at a dry-end of paper making to produce the lightweight digital printing media that is also coated. The treatments may include surface sizing agents, inorganic fillers or pigments, organic fillers or pigments, binders and other additives. Equipment that may be used to apply various treatments or coatings to the media, either on-line coating or off-line coating, includes, but is not limited to, a film size press, a rod size press and a pond size press. Other application methods include, but are not limited to, slot die application, roller application, fountain curtain application, blade application, rod application, air knife application, gravure application, and air brush application during paper manufacturing. The applied surface treatment is dried by convection, conduction, infra-red radiation, atmospheric exposure, or a combination of one or more of these, for example, before calendering.

As such, the lightweight digital printing medium or media according to the principles described herein includes within it scope, both uncoated base paper and coated base paper.

EXAMPLES

All measured values are within measurement tolerance for the equipment used, unless otherwise indicated.

Preparation of Digital Printing Media:

Example 1 (without BCTMP)

Media samples were made with a fiber mixture of 30% hardwood chemical pulp and 70% softwood chemical pulp. The hardwood chemical pulp and softwood chemical pulp were each kraft pulps obtained from Domtar Corporation, North America. The amounts were in percent by dry weight of total fiber in the fiber mixture. An ASA internal sizing agent was added to the fiber mixture in a dose of 1.6 kg/ton. The ASA was Nalsize™7540 obtained from Nalco, Naperville, Ill. Moreover, a wet-strength agent, Kymene™821, a polyamide-epichlorohydrin, from Ashland Inc., was added to the fiber mixture in a dose of 1% by total dry weight of the base paper. The fiber furnish was mixed in a stirred tank and then transferred to a fan pump of a Fourdrinier paper machine. The fiber furnish was refined to a CSF level of 450 ml. using a Beloit Jones double disk refiner (Beloit Corporation). The CSF was measured using a freeness tester according to TAPPI standard T227. The refined fiber furnish was formed into sheets of media samples using a 61 centimeters wide (or 24 inch wide) Fourdrinier paper machine having a 27.4 meter (or 90 foot) web length running at approximately 30.48 meters per minute (or 100 feet per minute). The Example 1 media samples had a basis weight or grammage of 53 gsm. Moreover, the Example 1 media samples had a caliper of 3.9 mils (or equivalently, 99.06 microns).

Example 2 (with BCTMP)

Media samples were made with a fiber mixture in percent of total dry weight of the fiber mixture of 30% hardwood chemical pulp, 40% softwood chemical pulp, and 30% BCTMP. The hardwood chemical pulp and softwood chemical pulp were kraft pulps obtained from Domtar Corporation. The BCTMP used was BCTMP 110-70-75 from Millar Western Forest Products Ltd., Edmonton, AB, Canada, where '110' referred to the CSF, '70' referred to the ISO brightness, and '75' was the percent of Aspen or hardwood fibers in the pulp with the remaining 25% being softwood fibers. The same ASA internal sizing agent and wet strength agent as used in Example 1 were added to the fiber mixture in Example 2 in the same dosing amounts, mixed together, and the fiber furnish was refined and formed into media sample sheets in the same manner and with the same basis weight or grammage and same caliper as described above for Example 1.

Preparation of Comparison Media:

Comparison Media 1: The same fiber mixture and the same ASA internal sizing agent and amount as in Example 1 were mixed to form a fiber furnish as provided in Example 1, but without the wet-strength agent. The fiber mixture was refined and formed into media sample sheets in the same manner and with the same basis weight or grammage and same caliper as Example 1.

Comparison Media 2: The same fiber mixture as in Example 1 was prepared, but without both of the ASA internal sizing agent and the wet-strength agent. The fiber mixture was refined and formed into media sample sheets in the same manner and with the same basis weight or grammage and same caliper as Example 1.

Comparison Media 3: The same fiber mixture of Example 2 and the same ASA internal sizing agent and amount as in Example 1 were mixed to form a fiber furnish as provided in Example 2, but without the wet-strength agent. The fiber mixture was refined and formed into media sample sheets in the same manner and with the same basis weight or grammage and same caliper as Example 1.

Comparison Media 4: The same fiber mixture as in Example 2 was prepared, but without both the ASA internal sizing agent and the wet-strength agent. The fiber mixture was refined and formed into media sample sheets in the same manner and with the same basis weight or grammage and same caliper as Example 1.

Flatness Measurements on Unprinted Media:

The flatness of unprinted Media sample sheets of Examples 1 and 2 and unprinted sample sheets of Comparison Media 1-4 was measured using a SICK IVP 3D camera-based laser profilometer system built at Hewlett-Packard using a commercial laser measuring unit and laser control/data capture software from SICK IVP AB, Linköping, Sweden, and an in-house constructed x-y table and control software. In particular, the laser profilometer system measured distance from a detector of the profilometer system to the surface of the respective media sample sheets. Each of the unprinted samples were oriented such that the laser read across the sample sheets in a CD direction, or short direction of the sheets, in designated locations on the respective sheets.

Preparation of Printed Media:

The same unprinted sample sheets of the Examples 1 and 2 Media that were measured for flatness, as described above, were printed on with an HP Edgeline printer, from Hewlett-Packard Co., Palo Alto, Calif., USA (HP), using HP A50 pigment inks (i.e., aqueous inkjet ink and digital inkjet printing). The printing process used involved 2 passes and six dry spin conditions to mimic high-speed, digital, web-press inkjet printing.

The same unprinted sample sheets of the Comparison Media 1-4 that were measured for flatness, as described above, were printed in the same way as the Examples 1 and 2 Media were printed.

Flatness Measurements on Printed Media:

The flatness of the same printed Media sample sheets of Examples 1 and 2 and the same printed Comparison Media 1-4 sample sheets was measured in a manner that was the same as the Flatness measurements for the unprinted media. The printed media was measured in substantially the same location as in the unprinted media.

RMS roughness or Flatness Change Determination:

The values for flatness of the unprinted media samples described above were subtracted from the values for flatness of the same media samples after printing, as described above. The difference values were analyzed using equation 1, as described above, and reported as Rq (RMS roughness) or flatness change. A lower Rq value represents less of a change in flatness between unprinted and printed media samples. Moreover, less change in flatness represents more dimensional stability and strength in the media samples to accommodate high moisture levels with digital inkjet printing.

Table 1 illustrates the results obtained for the various media samples described above.

TABLE 1

| Fiber Mixture | Additives: Internal Sizing Agent | Additives: Wet-Strength Agent | Rq Values |
|---|---|---|---|
| Media Example 1 = 30%/70% Hardwood/Softwood | ASA | Kymene ™ 821 | 0.31 |
| Comparison Media 1 | ASA | — | 0.35 |
| Comparison Media 2 | — | — | 0.37 |
| Media Example 2 = 30%/40%/30% Hardwood/Softwood/BCTMP | ASA | Kymene ™ 821 | 0.29 |
| Comparison Media 3 | ASA | — | 0.35 |
| Comparison Media 4 | — | — | 0.36 |

As shown in Table 1, the flatness change or Rq values were lowest for the samples that included the BCTMP, internal size and wet strength agents (Example 2). A reduced flatness change or Rq was also observed for samples without BCTMP but with the internal size and wet strength agents compared to the Comparison Media 1-2 samples. These results herein support a distinctiveness of the combination that comprises a fiber mixture having hardwood and softwood pulps with at least 0.5% by dry weight BCTMP based on total fiber in the mixture, an internal sizing agent, and at least 0.1% by total dry weight of the base paper of a wet strength agent to form a base paper of the lightweight digital printing medium according to the principles herein.

Thus there have been described examples of a lightweight digital printing medium that has a basis weight less than 100 gsm and a method of manufacturing lightweight digital printing media. A base paper of the lightweight digital printing medium includes fiber mixture having hardwood and softwood pulps with at least 0.5% by dry weight BCTMP based on total fiber in the mixture, an internal sizing agent, and at least 0.1% by total dry weight of the base paper of a wet strength agent. It should be understood that the above-described examples are merely illustrative of some of the many specific examples that represent the principles of what is claimed. Clearly, those skilled in the art can readily devise numerous other arrangements without departing from the scope defined by the following claims.

What is claimed is:

1. A lightweight digital printing medium comprising:

a base paper that comprises:

a fiber mixture of hardwood pulp and softwood pulp, the fiber mixture comprising chemical pulp and at least 5% by weight of total fiber in the fiber mixture being bleached, chemi-thermo-mechanical pulp (BCTMP);

an internal sizing agent for neutral or alkaline conditions; and a wet-strength agent that is a thermosetting resin in an amount that is at least 0.1% total dry weight of the base paper, the internal sizing agent and the wet-strength agent mixed with the fiber mixture, wherein the lightweight digital printing medium has a basis weight of less than 100 grams per square meter (gsm).

2. The lightweight digital printing medium of claim 1, wherein the BCTMP is one of hardwood pulp, softwood pulp and a mixture of hardwood and softwood pulps, the BCTMP being in an amount that ranges from 5% to about 60% by weight of total fiber in the fiber mixture.

3. The lightweight digital printing medium of claim 1, wherein the hardwood pulp is a chemical pulp, the softwood pulp being a chemical pulp, the BCTMP being a mixture of hardwood and softwood pulps, a ratio of total amounts of the hardwood pulp to softwood pulp in the fiber mixture being within a range of 1:2 to 2:1.

4. The lightweight digital printing medium of claim 1, wherein the internal sizing agent is selected from the group consisting of alkenyl succinic anhydride, alkyl ketene dimer, and a combination thereof provided in the fiber mixture in an amount ranging from about 0.5 kilograms per ton (kg/ton) to about 3 kg/ton.

5. The lightweight digital printing medium of claim 1, wherein the wet-strength agent is selected from the group consisting of polyamine-epichlorohydrin, polyamide-epichlorohydrin, polyamide-amine-epichlorohydrin, polyamide, epoxide, glyoxal, and a combination of two or more thereof, the amount of the wet strength agent being within a range of 0.1% to about 3% of total dry weight of the base paper.

6. The lightweight digital printing medium of claim 1, being a book-grade paper, wherein the basis weight is greater than 35 gsm and less than 75 gsm.

7. The lightweight digital printing medium of claim 1, having a root-mean-squared (RMS) flatness of less than 0.35.

8. A base paper of lightweight digital printing media comprising:

a fiber mixture comprising hardwood and softwood chemical pulps, and bleached chemi-thermo-mechanical pulp (BCTMP), the BCTMP being within a range of 5% to about 60% by weight of total fiber in the fiber mixture;

an internal sizing agent for neutral or alkaline conditions in a range of about 0.5 to about 3 kilograms per ton; and a wet-strength agent that is a thermosetting resin in a range of 0.1% to about 3% total dry weight of the base paper, the internal sizing agent and the wet-strength agent being mixed in the fiber mixture, wherein the base paper has a basis weight within a range of 35 to about 75 grams per square meter (gsm).

9. The lightweight digital printing medium of claim 1, wherein the wet-strength agent is a polyamide-epichlorohydrin resin.

10. The base paper of claim 8, wherein the wet-strength agent is a polyamide-epichlorohydrin resin.

11. The base paper of claim 8, wherein the BCTMP is in an amount that ranges from about 10% to about 50% by dry weight of total fiber in the fiber mixture, the BCTMP comprising both hardwood pulp and softwood pulp.

12. The base paper of claim 8, wherein the fiber mixture comprises about 30% of the hardwood chemical pulp, about 40% of the softwood chemical pulp and about 30% of the BCTMP by weight of total fiber in the fiber mixture, and wherein the fiber mixture has a Canadian Standard Freeness level within a range of about 350 to about 500 milliliters.

13. The base paper of claim 12, wherein the internal sizing agent is selected from the group consisting of alkenyl succinic anhydride, alkyl ketene dimer, and a combination thereof in an amount of about 1.6 kilograms per ton.

14. The base paper of claim 12, wherein the wet-strength agent is selected from the group consisting of polyamine-epichlorohydrin, polyamide-epichlorohydrin, polyamide-amine-epichlorohydrin, polyamide, epoxide, glyoxal, and a combination of two or more thereof, an amount of the wet strength agent being about 1% total dry weight of the base paper.

15. The base paper of claim 8, wherein the basis weight is within a range of about 40 gsm to about 70 gsm, the lightweight digital printing media being book-grade paper.

* * * * *